US006536084B2

(12) United States Patent
Davis

(10) Patent No.: US 6,536,084 B2
(45) Date of Patent: Mar. 25, 2003

(54) LOW PROFILE INTEGRATED OMEGA ZIPPER CLOSURE SYSTEM

(75) Inventor: Robert P. Davis, Vidalia, GA (US)

(73) Assignee: Ideal Fastener Corporation, Oxford, NC (US)

( * ) Notice: Subject to any disclaimer, the term of this patent is extended or adjusted under 35 U.S.C. 154(b) by 0 days.

(21) Appl. No.: 09/907,058

(22) Filed: Jul. 17, 2001

(65) Prior Publication Data

US 2002/0100149 A1 Aug. 1, 2002

Related U.S. Application Data

(60) Provisional application No. 60/265,205, filed on Jan. 30, 2001.

(51) Int. Cl.[7] ..... A44B 19/26
(52) U.S. Cl. ..... 24/415; 24/429
(58) Field of Search ..... 24/385–387, 388, 24/433, 415–431, 434, 436; 70/68; 190/119, 903

(56) References Cited

U.S. PATENT DOCUMENTS 2,438,614 A * 3/1948 Morin ..... 24/388
2,568,670 A * 9/1951 Traub et al. ..... 24/419 X
2,575,187 A * 11/1951 Shcaye ..... 24/418
2,575,201 A * 11/1951 Ulrich ..... 24/404
2,621,387 A * 12/1952 Williams ..... 24/386
2,701,903 A * 2/1955 Williams ..... 24/386
2,923,992 A * 2/1960 Armstrong et al. ..... 24/389
3,628,640 A * 12/1971 Molnar ..... 24/386 X
4,123,829 A * 11/1978 Takabatake ..... 24/386
5,027,477 A * 7/1991 Seron ..... 24/3
5,031,944 A * 7/1991 Keyaki ..... 24/387 X
5,860,192 A * 1/1999 Chung ..... 24/429
6,035,497 A * 3/2000 Jackson ..... 24/429

* cited by examiner

*Primary Examiner*—J. J. Swann
*Assistant Examiner*—Ruth C. Rodriguez
(74) *Attorney, Agent, or Firm*—Roberts Abokhair & Mardula, LLC

(57) ABSTRACT

A zipper closure system is disclosed comprising one or more slider bodies with a reinforced bracing integrated with a lock eyelet, a closed bail, slider body top and bottom platforms and a slider body diamond. A releasing pull tab assembly comprised of a pull tab channeled to receive a pull tab connector attaches to the slider body. The connector's head portion encompasses the slider body's bail and the connector's lower portion is mated with the pull tab securely attaching connector to the pull tab. At a predetermined force, the connector will release from the pull tab, releasing the slider body with no loss of functionality. The other components are designed to withstand a force in excess of the predetermined force. This release prevents damage to other components. The predetermined release force ranges from 25 to 200 pounds in alternate embodiments. A consumer can easily repair the unit by mating the original or replacement connector piece with the pull tab. The pull tab can be retro fit to other slider body systems. A lock eyelet designed to dock with a facing, opposing lock eyelet in a flush manner so as to lock without twisting the slider bodies is also disclosed. In another embodiment, a lock eyelet is designed to dock in a flush manner with a seam lock eyelet so as to lock without twisting seam lock or slider body. The seam lock is attached to a reinforced seam at the end of the zipper track.

28 Claims, 6 Drawing Sheets

LOW PROFILE INTEGRATED OMEGA ZIPPER CLOSURE SYSTEM

CROSS REFERENCE TO RELATED APPLICATIONS

This application claims priority under 35 U.S.C. §119(e) from provisional application No. 60/265,205, filed Jan. 30, 2001. The No. 60/265,205 provisional application is incorporated by reference herein, in its entirety, for all purposes.

FIELD OF THE INVENTION

The present invention relates to a reinforced, lockable zipper closure system. More specifically the present invention relates to an improved heavy duty slider body system comprising various components such as a unitized, reinforced slider body, an eyelet cast in the body, a slider body pull with releasing pull clip, simple repair of pull tab and a seam lock.

BACKGROUND

Zippers are used as closure devices for many common items such as garments, furniture and sporting goods including sleeping bags and tents. Luggage, sports bags and other products using locking zipper systems require heavy duty, lockable slider bodies. Some lockable slider body systems require the joinder of a pair of eyelets and an external lock inserted across the docked eyelets. Other systems use openings at the ends of the pullers to receive a lock. Sometimes a single slider body is used with a D-ring where the slider body's eyelet is locked to a D-ring mounted on a stationary object at the end of the zipper track. These traditional alternatives do not fit flush and are subject to excessive torque forces.

A zipper assembly traditionally comprises two opposing stringers, one or more slider bodies and a pull tab for each slider body. The stringers contain interlocking elements or teeth. The slider body has channels that span each of the opposing stringers. When the slider body is pulled along the stringers' longitudinal axis, the teeth close or open depending on which direction the slider body is pulled. A pull tab is used to facilitate the pulling of the slider body.

The pull tab has a gripping end and a connector end. A traditional method of attaching the pull tab to the slider body is to have the connector end of the pull tab formed to be an eyelet and to have an extrusion of the slider body secure the connector end. This extrusion is called a bail.

The bail is shaped like an arch and has a forward leg and a rear leg. The rear leg is manufactured in a slightly raised position. The pull tab connector is traditionally secured to the slider body by placing the pull tab connector eyelet under the raised bail leg and then the leg is squeezed closed thus securing the pull tab connector. Once secured, the pull tab pivots about the bail thus facilitating pulling the slider body in either direction.

Alternatively, the pull tab connector end is formed from flat stamped steel having opposing, inward pointing ears with a gap between the ears. The ears are inserted into indentations on either side of the slider body. The ears are then squeezed together closing the gap enough to secure the pull tab to the slider body. A bail that is deformed in order to secure the pull tab has been stressed and thus more likely to fracture. Pull tab ears tend to pull out of the slider body indentations with minimal torque force.

The slider body has, in addition to the bail and lock eyelet, a bottom and top plate and a slider body box or, as frequently referred to in the industry, as the slider body diamond. The bottom and top plates are in horizontal planes. The slider body diamond, located in the front of the zipper, lends strength and stability to the slider body. A lock eyelet is optionally mounted on the top plate in the front. The bail, shaped as an arch, is mounted on the top plate toward the rear.

Heavy duty zippers such as those used with luggage are subject to a lot of stress. These types of applications typically use zinc die cast slider body with a bail. The process of closing the bail to secure the pull tab causes stress and may cause cracks in the bail making it subject to fracture while in use. Repairing this type of breakage is costly and difficult. If the components of the slider body are reinforced so as to mitigate stress fracture, the zipper is prone to damage when external forces, such as mechanical baggage handlers, abuse the zipper. If the pull tab does not yield to excessive force, then other components of the zipper, such as the stringer, bail or lock eyelet may be damaged. Repair of such damaged components usually require expertise and tools not generally available at a retail shop. Often the luggage or other product to which the zipper is attached has to be sent away for repair or replacement. Repair, even if done at a retail location, requires substantial wait by the customer. Immediate repair is rarely available or practical.

Luggage zipper slider body systems are often designed with an eyelet to match up with a D-ring or a second zipper with a second eyelet so that a lock may be applied across the two eyelets (or eyelet and D-ring). Inserting a lock introduces another point where failure might occur in the zipper slider body locking system, particularly if the eyelets do no match up in a flush manner.

Areas of failure occurring with heavy duty zippers subject to substantial torque and shear force are: 1) the bail holding the pull tab connector eyelet; 2) the lock eyelet, particularly when a torque force is applied to the lock; and 3) the top and bottom slider body plates which may pull away from the slider body diamond. Traditional, heavy duty zipper slider body locking systems begin to fail at about 20–25 inch pounds of force at the bail, 12–15 inch pounds of rotational force at the eyelet, and 60–80 pounds force applied to the top and bottom plates. The stringers and the tape holding the stringer may also fail, but usually failure at the bail, lock eyelet, bottom plate or top plate occurs well before the 200 pounds of static force required to damage the stringers and the stringer tape. Heavy duty pull tabs rarely fail.

It is desirable to avert failures at such levels of force. Increased bail strength, lock eyelet reinforcement as well as bottom and top plate strength would help ameliorate the problem. An integrated manufacture of the slider body including the bail and lock eyelet, along with additional support structure for the lock eyelet would further help achieve this end.

Additionally, a pull design that releases under predetermined force levels so as to preserve the integrity of the rest of the zipper and yet is easily reparable with original parts is also desirable.

Pull designs are disclosed in Aoki et al, U.S. Pat. No. 4,920,615 (Aoki); Minami, U.S. Pat. No. 4,949,434 (Minami); and Jackson, U.S. Pat. No. 6,035,497 (Jackson), all of which are incorporated by reference in their entirety. Aoki discloses a slider body having a pull tab support, such that the pull tab can be removed and attached quickly by using a resilient V shaped retainer to secure the pull tab to the pull tab support.

Minami discloses a slider body fastener that is thinned in the body of the pull tab making the pull tab flexible. This design enhances safety aspects by lessening the chance of injury from the pull tab.

Jackson discloses a separable zipper pull tab that comprises a hook piece that inserts within the cavity of the pull tab, said hook piece frangibly secured to the pull tab such that when sufficient force is applied to the zipper, the hook piece detaches from the pull tab. Modular repair requires new parts or the application of adhesives. Jackson requires the introduction of either a shear pin, retaining clip or adhesive to secure the hook piece to the pull tab. As noted above, the bail and lock eyelet are particularly subject to failure at common usage levels of force.

Another embodiment described in Jackson has a non-secured, free end of a connecting arm of the hook yield so that the end of the connecting arm will disengage from the pull tab cavity. Under this condition the hook piece would have to be removed in order to implement repair. The hook piece, if reused, has been deformed thus lowering the separation force threshold.

In the traditional design, when the pull tab is separated from the slider body most of the time the failure occurs at the slider body. This requires replacement or repair of the entire zipper or slider body, incurring more cost than simply replacing the pull tab. Modular replacement of a pull tab requires multiple steps and new parts or materials to implement a repair. If a component of the slider body breaks, such as at the bail, the ability to implement modular repair of the pull tab is not meaningful.

Traditionally there are three different methods to secure (lock) a zipper opening when using a shackled type pad lock or combination lock. The first method, two zipper slider bodies are equipped with openings in their respective pullers to receive the shackle of a lock. The two slider bodies come together from opposite directions. When close enough, the shackle of the lock is inserted into the two opposing puller openings.

The drawback to this first method is that the pullers do not lie flatly against the zipper when the lock is installed and shackled. In the locked position the shackle forces the pullers, as well as the lock, to extend upward, away from the flat surface area of the zipper opening. While in this attitude the pullers and lock are positioned in a way that perpetuates damage to the lock, pullers, slider bodies, zipper and the product to which the zipper is attached.

Damage occurring in this mode results in major, expensive repairs to the product. In extreme cases the owner is forced to discard and replace the entire product. Further, the zipper slider bodies are positioned or parked anywhere on the zipper opening. Extra security or reinforcement to the product or zipper seam cannot be localized due to the slider bodies winding up in various locations on the zipper opening.

In the second method, two zipper slider bodies equipped with lock eyelets designed so that the shackle of a lock can be inserted through opposing, aligned eyelets. The two slider bodies come together from opposing directions and allow the eyelets to overlap creating a loop or hole the lock shackle can be inserted. While the pullers lay flatter, the lock itself is forced upward away from the flat surface area of the zipper opening and the product's surface. When subjected to this attitude the lock is positioned in a way that damage to the lock, slider body, zipper and the product to which the zipper is attached is still likely.

Further, like the first method, the slider bodies may be positioned anywhere along the stringers. Extra security or reinforcement to the product or zipper seam cannot be localized due to the slider bodies winding up in various locations on the zipper opening.

In the third method, the product itself is fitted with a square loop, round ring or a D-ring. Theses rings or loops are attached to the product by means of a webbing or strap like material that is stitched directly into a seam where the zipper terminates. This device is a lock receptacle. A single zipper slider body equipped with a puller that has an opening or a lock eyelet is positioned at the terminus, i.e. zipped closed. The lock shackle is inserted through the opening provided by puller or lock eyelet and the ring's opening. When locked, the zipper slider body is secured to the ring at a reinforced location.

This method allows the puller to lay flatter. Further, the lock can be parked in an area where the least amount of damage can occur. Extra security or reinforcement to the product or zipper seam is localized using this method. However, since the lock is forced upward away from the flat surface area of the zipper opening, damage may occur. However, the lock and puller being pitched upward is still prone to damage that may create major repair or replacement cost. Further, a slider body lock eyelet coupled with a round ring or D-ring sacrifices strength compared to joining two slider body lock eyelets.

What is needed is a strengthened zipper that resists fracture or separation and, if excessive forces are applied to the zipper, a release needs to occur at the point of easiest repair so as to prevent damage to the other zipper components and to the product to which the zipper is attached. Further, a locking system where the lock lays flat would help avoid damage precipitated by a lock that is positioned off of the surface of the product being secured. Use of a lock receptacle at a reinforced location is also desirable.

Utilizing a lock that releases when under stress before the slider body lock eyelet fractures is also desirable. Replacing a released or fractured lock instead of having to replace the zipper system or event the product attached to the zipper system is more cost effective. If there is to be damage, it is preferred that the damage be localized to the lock or some easily repaired, inexpensive component of the locking system.

In the event there is some damage, a simple, inexpensive repair executable by the consumer with a common household tool and without the need of a sewing machine or additional materials such as shear pins, retention clips or adhesive is preferred. A simple repair system facilitates quick service for the traveling public at travel centers such as airports where luggage sellers can also implement a repair inexpensively and with minimum delay. Retailers at travel centers, luggage repair shops and luggage shops can maintain a supply of modular pullers and pull tab connector pieces, thus affording quick and inexpensive zipper system repair.

BRIEF SUMMARY OF THE INVENTION

It is an object of the present invention to provide a pull tab design in which a pull tab connector secures attachment between a pull tab and to a zipper slider body such that if undue stress is applied, the pull tab link will release before any material damage to the zipper or the product to which the zipper is attached such as a sports bag or luggage. The term "product" is used in this description to mean the object to which the zipper or zipper system is attached.

It is still another object of the present invention for the pull tab connector to release from the pull tab at a predetermined force.

It is yet another object of the present invention for the pull tab connector to release from the pull tab at a static force of 100 pounds.

It is another object of the invention to provide an economical and simple method of restoring a released pull tab link rather than replacing the entire pull tab or replacing or repairing the slider body or zipper.

It is yet another object of this invention to implement a repair of a released pull tab link with a single operation.

It is still another object of this invention to repair a broken pull tab of a slider body system of another design with the pull tab of the present invention.

It is another object of the present invention to provide an economical and convenient design for manufacturing a zipper pull tab that accomplishes the goals described herein.

It is yet another object of the present invention to strengthen the slider body.

It is still another object of the present invention to strengthen the slider body bail.

It is another object of the present invention to strengthen the lock eyelet by integrating the lock eyelet with the bail thus strengthening both components of the slider body.

It is yet another object of the present invention to strengthen the diamond and slider body by integrating a bracing with the lock eyelet, bottom platform, top platform and diamond.

It is another object of the present invention for any component of the slider body to withstand a force of 100 pounds without failing.

It is another object of the present invention to have a slider body locking system where two slider bodies are employed each with an lock eyelet that when the two opposing lock eyelets are aligned a lock may be applied across the eyelets and further, the eyelets are each offset from center such that the eyelets dock in a flush manner.

It is still a further object of the present invention to have a slider body locking system where there is a slider body lock eyelet and a seam lock eyelet such when the slider body lock eyelet is aligned with the seam lock eyelet a lock may be applied across the eyelets. Further, the eyelets are each offset from center such that the eyelets dock in a flush manner, thus allowing the securing lock to lie flat.

In one embodiment of the present invention, the zipper slider body is optionally produced from a unitized die cast zinc alloy. The bail, the arch at the top rear of the slider body platform (note: the term "platform" is used as a synonym of "plate"), is cast in a closed position thus strengthening the bail. In another embodiment, the lock eyelet, the eyelet at the top front of the slider body, shares a common wall with the bail thus it is reinforced. A lock eyelet bracing, located in the front and beneath the eyelet is integrated with and protrudes from the front of the slider body provides additional strength. In another embodiment, the bracing is integrated with the lower diamond of the slider body as well as with the lock eyelet, the slider body top platform and the lower slider body platform. This greatly strengthens the entire slider body.

In one embodiment of the present invention, the pull tab is comprised of two pieces, a pull tab and pull tab connector. The connector is shaped substantially like the Greek letter Omega. The pull tab is optionally die cast zinc alloy. It has a cavity to receive the connector. Bore holes are present in the sidewalls of the pull tab. The connector clip is constructed from highly resilient material selected from the group of materials including spring steel, carbon fiber composite, fiber reinforced plastics, aluminum, titanium, copper beryllium and alloys or mixtures. The circular face of the clip encircles the rear bail leg. The legs of the Omega clip are compressed into the cavity of the pull tab. Channels in the pull tab cavity receive and guide the pull connector. Small angled appendages at the base of each connector leg, referred to as ears, slide down the interior channels of the pull tab cavity, guided to bore holes at either side of the pull tab cavity. Once aligned, the ears firmly position into the bore holes and the pull tab is securely fastened to the slider body bail via the connector. Upon force, the resilient connector flexes. At a predetermined force, a release occurs. To repair, the Omega connector and pull tab are reused. A new pull tab can be used to restore the pull tab connection to its original strength.

Other advantages and features of the present invention will become manifest to those skilled in the art upon making reference to the following detailed description and the accompanying drawings in which a preferred embodiment incorporating the principles of the present invention is shown by way of illustrative example.

DETAILED DESCRIPTION OF THE INVENTION

Figure 1A:
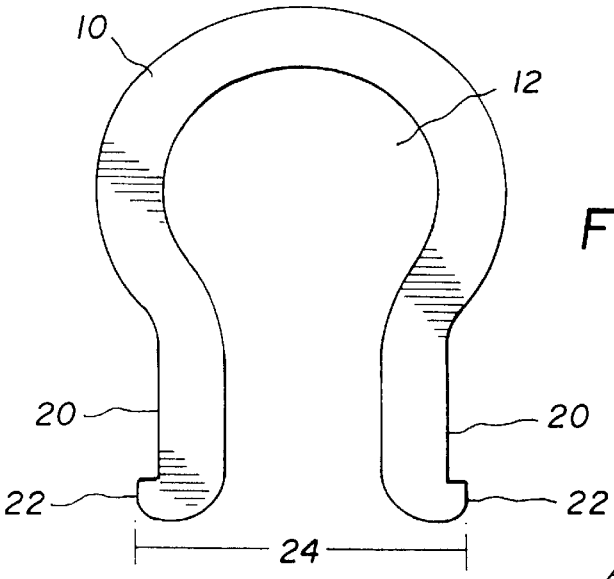
FIG. 1A illustrates a pull tab Omega connector in accordance with one embodiment of the present invention.

In one embodiment, the present invention provides a pull tab design in which a pull tab connector encompasses the slider body bail leg at its head end and is securely mated with the pull tab at its lower end. Upon the application of a force exceeding a designed threshold limit, the pull tab connector releases from the pull tab. This release will avoid damage to the other components of the zipper and the product to which the zipper is attached. Further, there is functional preservation of the pull tab and the pull tab connector so that they may be reassembled without replacement parts or materials.

In another embodiment of the present invention, a releasing pull tab comprising a connector piece and pull tab is disclosed. The connector piece has a closed top portion and one or more legs spanning from the closed top portion to an open bottom end. The closed top portion of the connector piece inner surface is concave in one embodiment of the invention. One embodiment uses two legs. Each leg is compressible toward the longitudinal axis. At the bottom end of each leg, an ear protrudes outward at an angle from the compression axis of the leg. The ears protrude either at an acute angle, or a right angle or an obtuse angle in alternate embodiments. The lesser the angel, the greater the bite and the greater the force needed before release will occur.

The connector piece is made from high tensile material optionally from a group of materials including spring steel, carbon fiber composite, fiber reinforced plastics, aluminum, titanium, copper beryllium and alloys or mixtures thereof.

The compressed connector piece is inserted into the pull tab. The pull tab has an interior cavity, a channel to receive each compressed connector leg and an internal bore hole to receive each connector piece ear. One embodiment has bore holes located in the sidewalls of the pull tab.

The ears release from the bore holes at a predetermined pull force, thus releasing the connector from the pull tab. The predetermined pull force is set to be lower than a force sufficient to break the closed top portion of the connector piece, the components of the zipper system and the product attached to the zipper system. The released connector and pull tab are functionally preserved thus allowing reuse and reassembly without replacing the components.

In a different embodiment, each leg is forced outward, away from the longitudinal axis. The ears protrude inward and there are internal channels allowing the resilient connector legs to spring toward the center. The connector piece is secured to the pull tab through tension as described in the preceding embodiment, however, in this embodiment, the tension securing the legs is an inward force.

The pull tab is optionally manufactured by die casting or molding processes. The optional materials include zinc alloy, carbon fiber composite, fiber reinforced plastics, steel, aluminum, titanium, copper beryllium and alloys and mixtures thereof. One embodiment of the invention establishes the predetermined pull force required to release the ears from the bore holes at between 25 and 200 pounds.

Further, this present invention allows reassembly of the pull tab by the consumer without the need for sophisticated tools or know how. If any tools were needed, those would be limited to common household tools such as a pair of pliers. The consumer needs no other parts to make the repair provided the pull tab connector is available. If the connector needs to be replaced it is relatively inexpensive. The pull tab design allows an easy, simple and economical repair of the pull tab in lieu of a costly, difficult repair or replacement of the pull tab, other zipper parts or the product to which the zipper is attached that may be damaged using other zipper systems.

This present invention also affords a single step repair of the pull tab assembly. The pull tab connector is merely reinserted into the pull tab channel to reestablish the connection. No additional parts or adhesive are required. Using nothing more than a pair of pliers, the consumer may quickly and inexpensively repair the zipper. The present invention allows for quick and inexpensive repair at a retail establishment or by the consumer. Either the consumer or the repair shop may use a spare connector in lieu of the original connector when repairing.

The present invention's modular pull tab design further allows simple repair to other zipper systems, provided the bail is intact, where the pull tab has been broken off of the slider body.

One embodiment of the present invention provides a fully integrated slider body designed and manufactured to resist breakage from shear and torque forces substantially greater than current art allows. A zipper slider body, for one embodiment, comprises a slider body box, slider body bottom platform, slider body top platform and a slider body bail connected on top and rear of the slider body top platform where a slider body bail is manufactured in a closed configuration. Another embodiment includes a slider body lock eyelet positioned forward and on top of the slider body top platform where the slider body bail is integrated with the lock eyelet. One embodiment includes incorporating a lock eyelet bracing positioned beneath the lock eyelet so that the lock eyelet bracing is integrated with the bottom and rear of the lock eyelet as well as the slider body top and bottom platforms and the slider body box. This design enhances strength by distributing stress across elements of the zipper slider body. Separate embodiments provide for slider body resistance to breakage and fracture of any component at less than 100 pounds of force, at less than 150 pounds of force and less than 200 pounds of force. Stringers (rows of teeth) and stringer tape will remain intact at pull forces of less than 200 pounds.

While the present invention identifies a top and bottom platform in addition to a slider body box, it is preferred that all these elements are a single cast or molded unit. Another embodiment provides for slider body manufacture using die cast or mold process using a material selected from the group of materials including zinc alloy, carbon fiber composite, fiber reinforced plastics, steel, aluminum, titanium, copper beryllium and alloys or mixtures thereof.

Another embodiment discloses a zipper locking system using a plurality of zipper apparatus, each zipper apparatus consisting of a releasing pull tab, a resilient connector piece, and a zipper slider body with lock eyelet. The lock eyelet's rear wall is integrated with the slider body bail's forward wall. Further a slider body bracing is positioned beneath the lock eyelet integrated with the bottom and rear of the lock eyelet. The bracing is also integrated with the front aspect of the slider body. When zipper apparatuses are opposing one another and drawn together, an external lock arm inserted through each slider body lock eyelet will secure the zipper apparatuses.

One embodiment allows for each slider body lock eyelet to be reciprocally offset on one side of the longitudinal axis of the slider body so when opposing and facing zipper apparatuses are joined the lock eyelets fit flush.

Separate embodiments require that the locking system be able to withstand forces of, in the alternate, 100 pounds, 150 pounds and 200 pounds without breaking. Another embodiment discloses release of the pull tab at a force within the range of 25 to 100 pounds. A separate embodiment provides for pull tab separation at a predetermined force of 100 pounds.

One embodiment provides for a manufacture of the zipper locking system by die cast or mold process using a material from the group including zinc alloy, carbon fiber composite, fiber reinforced plastics, steel, aluminum, titanium, copper beryllium and alloys or mixtures thereof.

Another embodiment discloses a locking zipper system with a zipper apparatus including a lock eyelet, as described above, and a seam lock. The seam lock comprises a base, a neck, an eyelet face and an eyelet centered in the eyelet face. The base is fastened to the product being secured by the zipper locking system. The base is an elongated ellipse. The base forms a slot in its center along its longitudinal axis. A heavy duty strap is inserted through the slot and the strap ends are fastened to the product to be secured by the zipper locking system. The seam lock is positioned at the product's seam at the end of the zipper's stringer where the zipper is in a closed position.

Sitting on top of the base is an eyelet and a bracing spanning from the front underside of the eyelet to the base. The seam lock eyelet is positioned so that an opposing lock eyelet on the slider body will align. When the slider body is drawn to the seam lock, the eyelets align and an external lock arm can be inserted through the opposing lock eyelets securing the zipper apparatus to the seam lock.

An embodiment discloses a zipper locking system using a seam lock and slider body lock eyelet where the predetermined force of between 25 and 100 pounds is required to cause pull tab separation. A different embodiment requires a force of 100 pounds to cause a pull tab separation.

Another set of embodiments require, in the alternative, forces of 100 pounds, 150 pounds, and 200 pounds to be present before the zipper locking system with seam lock breaks.

Another embodiment of the present invention discloses a zipper system with a single slider body including a lock eyelet and a seam lock with opposing eyelet. In this embodiment, the eyelets are offset from center thus providing a flush fit when docking.

Referring to FIG. 1A, a pull tab connector in accordance with one embodiment of the present invention is illustrated. The overall shape is substantially similar to the Greek letter Omega. The curved shape of the top portion 10 allows full pivoting about a zipper slider body. It is not intended to exclude from the present invention other top portion shapes that may allow pull tab pivoting. The top connector portion outlines opening 12. The connector is optionally made from high tensile spring steel in this embodiment. The material is extremely strong and will flex well before it will break. The connector has legs 20. At the bottom of the legs are appendages called ears 22. The ears are at approximately right angles to the longitudinal axis in this embodiment. The angle between the ears and legs may be at other than 90 degrees, which will be discussed later. If the consumer needs to repair the pull tab, compression of the connector can be done with a readily available tool such as a pair of pliers.

Another embodiment of the present invention allows the re-insertion of the connector without the use of any tools. The span between connector ears' outer edges, or distance 24, is such that the legs fit within the opening of the pull tab. Pushing the connector into the pull tab compresses the legs until the ears 22 are aligned with the bore holes 36 illustrated in FIG. 2A and FIG. 2B. The tension in the legs release to secure the connector in the pull tab.

Figure 1B:
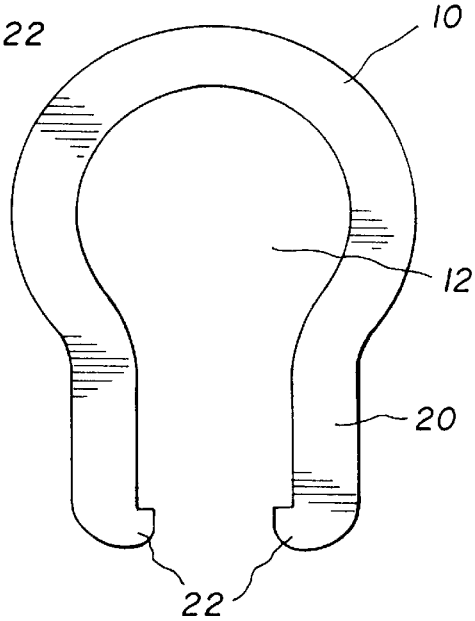
FIG. 1B illustrates a pull tab connector in accordance with another embodiment of the present invention.

Referring to FIG. 1B, a pull tab connector in accordance with another embodiment of the present invention is illustrated. The overall shape is like a key hole. The curved shape of the top portion 10 allows full pivoting about a zipper slider body. It is not intended to exclude from the present invention other top portion shapes that may allow pull tab pivoting. The top connector portion outlines opening 12. The connector is optionally made from high tensile spring steel in this embodiment. The material is extremely strong and will flex well before it will break. The connector has legs 20. At the bottom of the legs are appendages called ears 22 which are at approximately right angles to the longitudinal axis and pointed inward in this embodiment. The angle between the ears. and legs may be at other than 90 degrees. If the consumer needs to repair the pull tab, the connector would be inserted into the pull tab that is channeled to receive the key hole shaped connector clip ears 22. See "Referring to FIG. 4B" for further discussion as to the mating of the key hole connector and pull tab for this embodiment of the present invention.

Figure 2A:
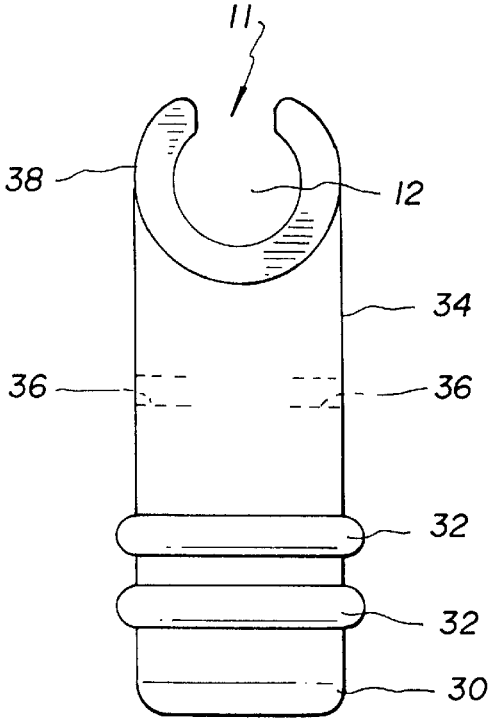
FIG. 2A illustrates a pull tab in accordance with one embodiment of the present invention.

Referring to FIG. 2A, a pull tab in accordance with one embodiment of the present invention is illustrated. The pull tab is optionally manufactured by a die cast process and is made of a zinc alloy. It is not intended that other manufacturing processes and materials be excluded from the implementation of the present invention. Other metal alloys and plastic compounds may be utilized. The upper portion of the pull tab has a cavity to receive the pull tab connector. Further the cavity is channeled and tapered so as to guide the ears of a compressed tab pull connector to bore holes 36. The compressed connector legs and ears are inserted in the opening 11 at the top of the pull tab. Once inserted in the channeled cavity, the pull tab channel walls maintain compression. The pull tab connector ears are guided to the bore holes 36 as the pull tab connector is forced downward within the pull tab channel. Once the connector ears 22 are aligned with the bore holes 36, the connector's tension characteristics force the connector ears 22 to engage in the bore holes 36. The connector can be removed by applying compression forces through slots in the upper sidewalls 38 or through exterior openings of the bore holes 36. Sidewalls 34 are closed between the upper sidewall slots 38 and bore holes 36. Bore holes 36 are located on opposite sides of the pull tab. The gripping area 30, 32 is located below the bore holes 36. Note the bore holes 36 extend through the sidewalls 34 thus facilitating in the release of an inserted pull tab connector.

Alternative design of placing bore holes aligned on the top and bottom surface relative to the longitudinal axis would afford separation between the holes of up to the thickness of the pull tab. If bore holes are separated by the width of the pull tab as opposed to the thickness of the pull tab, manufacturing tolerances are less stringent. Another design using only a single hole to secure the connector to the pull tab is workable but subject to wide variances of shear force and torque, dependent on the vector direction of the force.

If excessive force is applied to the pull tab top connector portion 10, the ears 22 will compress and pull out of the bore holes. This release mechanism is part of the pull tab design to avoid fracture or other damage to the zipper slider body, other zipper parts and the product to which the zipper is attached.

In one embodiment of the present invention, raised bands 32 are added for design and gripping utility in the lower section of the pull tab.

Figure 2B:
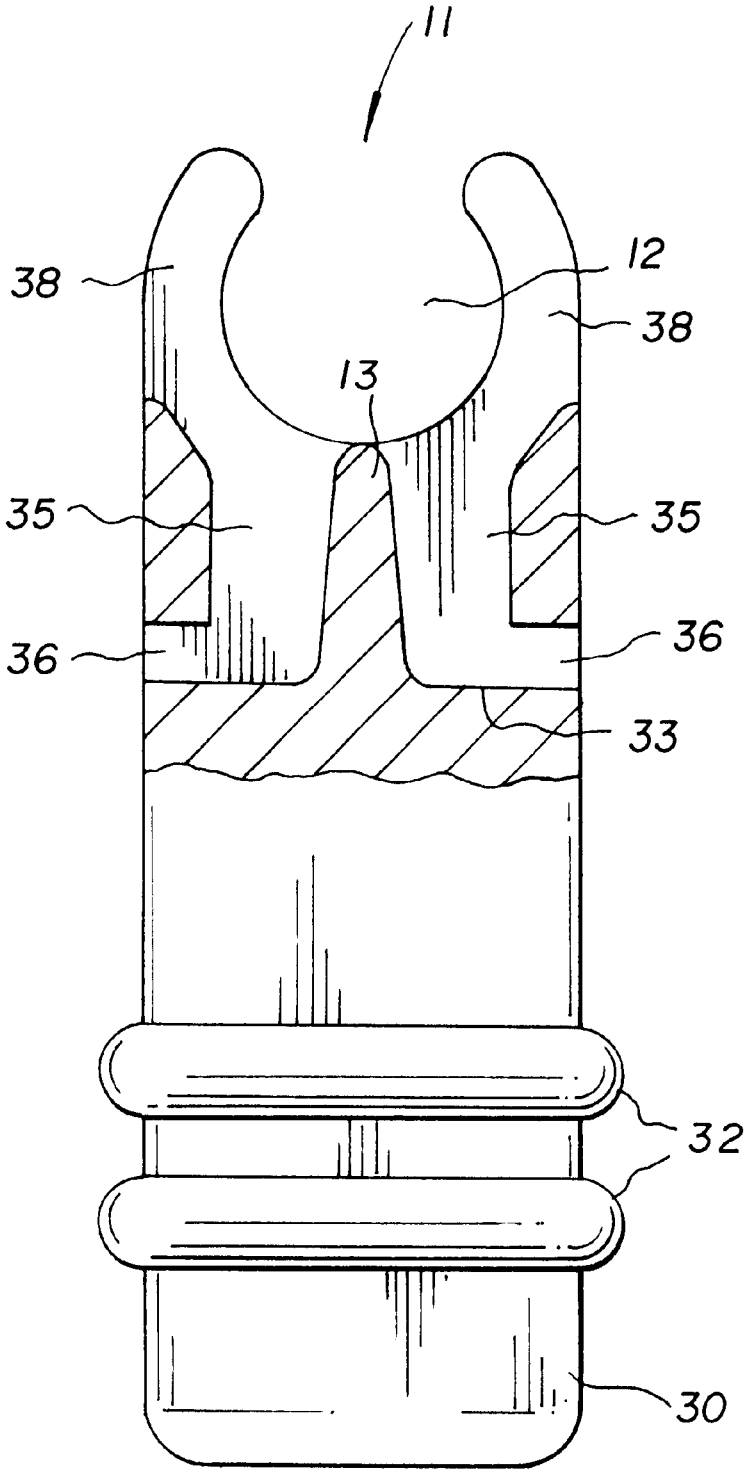
FIG. 2B illustrates a pull tab interior cavity in accordance with one embodiment of the present invention.

Referring to FIG. 2B, a cross section of the pull tab back half viewing from the front in accordance with one embodiment is illustrated. The diagonal lines represent the back wall of the pull tab. The tab is hollowed from the top down to gripping portion as marked by delimiter 33. Below delimiter 33, the pull tab is solid. A channel 35 extends down each sidewall to the bore hole 36. A central channel divider 13 place boundaries on the channels. The channel guides the connector leg ears 22 up to the bore holes 36. At that point the ears 22 spring into the bore holes 36 and are securely position through tension force. The tension force is overcome, resulting in a release of the connector from the pull tab, at a predetermined pull force.

Figure 3:
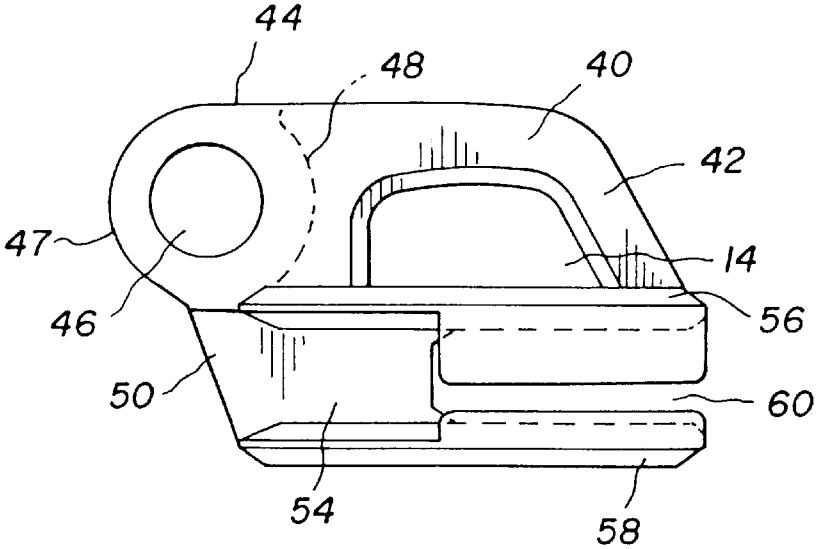
FIG. 3 illustrates a side view of a zipper slider body containing a closed bail, a reinforced lock eyelet and a bracing in accordance with one embodiment of the present invention.

Referring to FIG. 3, a side view of a zipper slider body in accordance with one embodiment of the present invention is illustrated. In this embodiment, zipper slider body components comprise a bail 40, a lock eyelet 44, a bracing 50, a slider body diamond 54, a slider body top platform 56, a slider body bottom platform 58 and stringer channels 60. For purposes of this description the term "slider body box" or "box" is synonymous with "slider body diamond" and "diamond". A slider body box 54 is sandwiched between the top and bottom platforms of the zipper slider body, starting in the front and spanning about one-third the length of the slider body along the longitudinal axis having a front face, a rear tapered face, a top aspect and a bottom aspect. The slider body box has a left side aspect and a right side aspect; the side aspects are in a vertical plane. The slider body top platform 56 lies in a horizontal plane mounted on the top aspect of the slider body box 54. The slider body bottom platform 58 lies in a horizontal plane mounted on the bottom aspect of the slider body box 54.

The bail 40 has a rear bail leg 42 and a bail opening 14 to receive the top connector portion 10. The bail is integrated with the slider body top platform 56 as well as with the lock eyelet 44 providing extra strength. The traditional bail rear leg 42 is manufactured in an elevated position raised off of the slider body top platform. The rear bail leg 42 in the preferred embodiment is manufactured integrated with and in contact with the top platform. This avoids the traditional requirement to deform the bail leg to secure the pull tab and thus avoid structural stress. It should be noted that the pull tab mechanism of the present invention may be retrofit to a slider body that was manufactured with an open bail construction.

The lock eyelet 44 has an opening 46 to receive a lock. A bracing 50 is integrated with the lock eyelet 44 in the front and underside of the eyelet, sloping backward and downward, thus contacting the slider body top platform 56, the bottom slider body platform 58, and the slider body box 54 front face. The bracing is designed to strengthen the entire slider body. Many failures occurred in the traditionally designed lock eyelet due to extreme torque force applied when an attached lock is twisted or pulled during luggage handling. The reinforced design avoids having to replace the slider body because the strengthened lock eyelet will resist forces in excess of 100 inch pounds.

The slider body is optionally manufactured by a die cast process and is made of a zinc alloy. It is not intended that other manufacturing processes and materials be excluded from the implementation of the present invention. Other metal alloys and plastic compounds may be utilized. A unitized, integrated slider body is the preferred embodiment of the present invention. The slider body strength is maximized when all the elements comprising the slider body are manufactured as a single unit.

In accordance with an embodiment of the present invention, the lock eyelet is offset to dock in a flush manner with an opposing slider body lock eyelet. Dotted line 48 indicates that the lock eyelet, offset to one side, provides a circular indentation, or receiving concavity so as to receive the curved leading edge 47 of an opposing, facing slider body lock eyelet. This arrangement optimizes stability of mated, locked eyelets thus lessening torque stress and breakage.

Figure 4B:
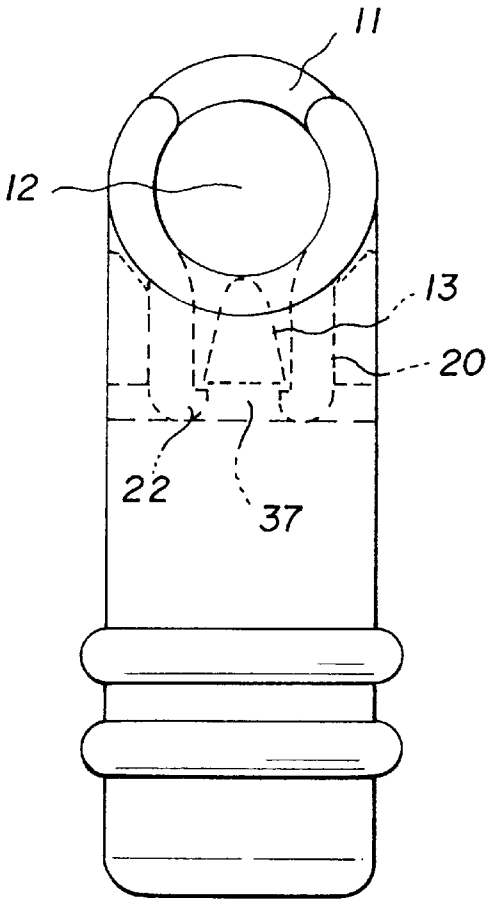
FIG. 4B illustrates a pull tab connector as inserted in a pull tab in accordance with another embodiment of the present invention.
Figure 4A:
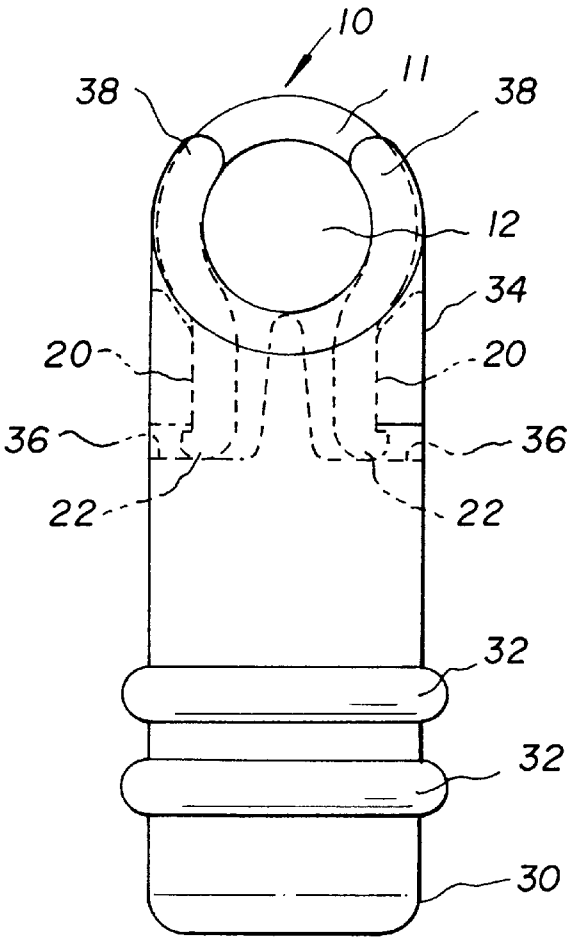
FIG. 4A illustrates a pull tab connector as inserted in a pull tab in accordance with one embodiment of the present invention.

Referring to FIG. 4A, a pull tab connector inserted in a pull tab forming an assembled zipper pull tab in accordance with one embodiment of the present invention is illustrated. Legs 20 are compressed and inserted into opening 11. The connector is pushed down the channel guides until the connector ears 22 locate bore holes 36. Due to the high tensile characteristics of the pull tab connector, the ears 22 firmly position in the bore holes 36. Ears are at right angle to the connector's longitudinal axis in one embodiment. An alternate embodiment may provide for an acute angle, i.e. the ear will be angled upward. If an acute angle is used, the bite and resistance to release will increase. Another alternate might provide for an obtuse angle, i.e., the ear will be angled downward. Use of an obtuse angle would decrease the bite and resistance to release. An alternative embodiment has convex ears positioning in concave receiving holes. This embodiment would further diminish the release resistance. The shape of the ears and the receiving receptacles are varied depending on the desired predetermined force to cause a release and depending on the material utilized.

If sufficient force is applied to the top connector portion 10, the connector ears 22 will compress and the pull tab connector and pull tab will separate, effectively releasing the pull tab from the slider body. In this way, potential damage to the slider body components, the zipper, the pull tab and the product to which the zipper is attached. The pull tab may lose some of its strength when the connector ears are pulled out of the bore holes due to wear at the bore holes. The consumer can easily reassemble the pull tab thus implementing a simple and cost free repair. A lost pull tab connector can easily be replaced without incurring significant cost of repairing the whole zipper assembly. If the consumer wants the original strength restored, a new pull tab is used. Thus a simple, single step repair of the zipper is easily achieved. The luggage vendor might even include a spare connector and pull tab much like some clothing vendors supply spare buttons.

Referring to FIG. 4B, a keyhole shaped pull tab connector is inserted in a pull tab forming an assembled zipper pull tab in accordance with one embodiment of the present invention is illustrated. Legs 20 are inserted into opening 11. The center guide 13 is channeled on either side to receive the connector piece's ears. The connector is pushed down the channel guides, which are sloped outward, deforming the connector legs 20, outward. When the connector ears 22 locate receiving channel 37, the ears 22 firmly position in the channel 37 due to the high tensile characteristics of the connector forcing the legs inward. Ears are at right angle to the connector's longitudinal axis in one embodiment. An alternate embodiment may provide for an acute angle, i.e. the ear will be angled upward. If an acute angle is used, the bite and resistance to release will increase. Another alternate might provide for an obtuse angle, i.e., the ear will be angled downward. Use of an obtuse angle would decrease the bite and resistance to release. An alternative embodiment has convex ears positioning in concave receiving holes. This embodiment would further diminish the release resistance. The shape of the ears and the receiving receptacles are varied depending on the desired predetermined force to cause a release and depending on the material utilized.

If sufficient force is applied to the top connector portion 10, the connector ears 22 will outwardly deform and the pull tab connector and pull tab will separate, effectively releasing the pull tab from the slider body. In this way, potential damage to the slider body components, the zipper, the pull tab and product to which the zipper is attached are avoided. The pull tab may lose some of its strength when the connector ears are pulled out of the receiving channels due to wear at the channel walls. The consumer can easily reassemble the pull tab thus implementing a simple and cost free repair. A lost pull tab connector can easily be replaced without incurring significant cost of repairing the whole zipper assembly. If the consumer wants the original strength restored, a new pull tab is used. Thus a simple, single step repair of the zipper is easily achieved. The luggage vendor might even include a spare connector and pull tab much like some clothing vendors supply spare buttons.

Figure 5:
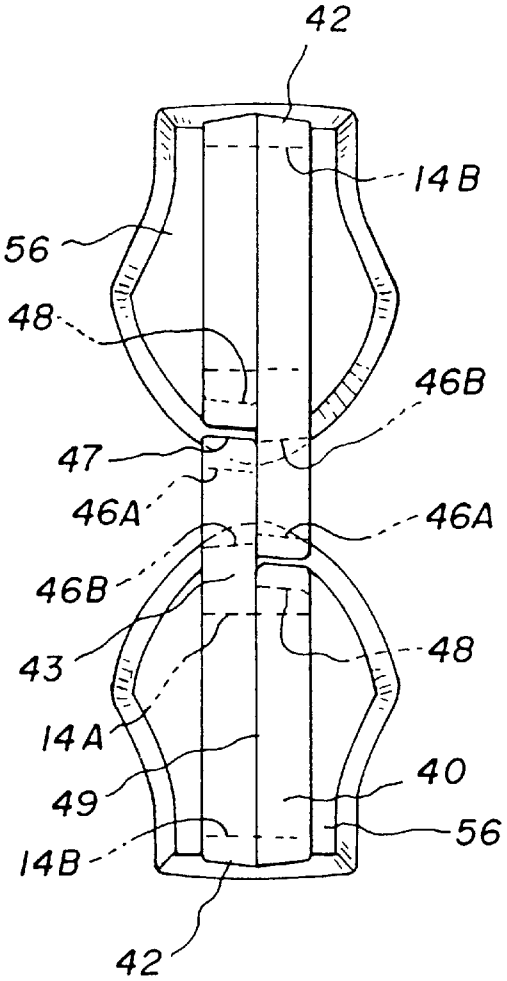
FIG. 5 illustrates a top view of opposing, facing zipper slider bodies in accordance with one embodiment of the present invention.

Referring to FIG. 5, a top view of two opposing, facing zipper slider bodies in accordance with one embodiment of the present invention is illustrated. In this embodiment, each zipper slider body comprise a bail 40, a bail rear leg 42, the bail aperture leading edge 14A, the bail aperture trailing edge 14B, a common wall 43 between the bail and the lock eyelet, a lock eyelet, the lock eyelet aperture leading edge 46A, the lock eyelet aperture trailing edge 46B, a center line 49 spanning the length of the lock eyelet and the bail, and a slider body top platform 56. Dotted lines reflect structures or apertures that lie below the top view.

Receiving concavity 48 described in FIG. 3, accepts the leading edge 47 of the opposing slider body's lock eyelet. FIG. 5 depicts the opposing slider bodies in near, but not completed docking position Opening 46 described in FIG. 3 is positioned within the lock eyelet and is illustrated as dotted lines 46A and 46B. This aperture allows the insertion of a lock. Docking of the facing slider bodies is complete when leading edge 47 of one slider body abuts the concavity wall 48 of the opposing slider body. The apertures 46 of each lock eyelet are aligned allowing a clean insertion of an external locking shackle. This arrangement provides for stability and minimum torque stress.

The bail opening shown in FIG. 3 as 14 is presented in FIG. 5 by dotted lines 14A and 14B. This opening allows the pull tab connector piece to encompass the rear bail leg 42. Strength is gained in this embodiment of the present invention by integrating the lock eyelet rear wall with the bails forward wall and illustrated in FIG. 5 as 43. Center line 49 delineates the right and left top sides of the slider body. In this embodiment, the lock eyelet is positioned at the center line at the left of center. This offset allows a flush docking with an opposing, facing slider body lock eyelet.

In lieu of a slider body lock eyelet aligning with an opposing slider body lock eyelet, a seam lock is used in another embodiment of the present invention. A seam lock is a device anchored with a strap to the product to be secured by the zipper locking system at the closed position terminus of the stringer tape. When the zipper is fully closed, the lone slider body's lock eyelet aligns with an opposing, facing lock eyelet positioned on the seam lock. This match up allows a flush docking of the slider body lock eyelet with the seam lock's eyelet much the same as if two opposing slider bodies were docked.

Figure 6A:
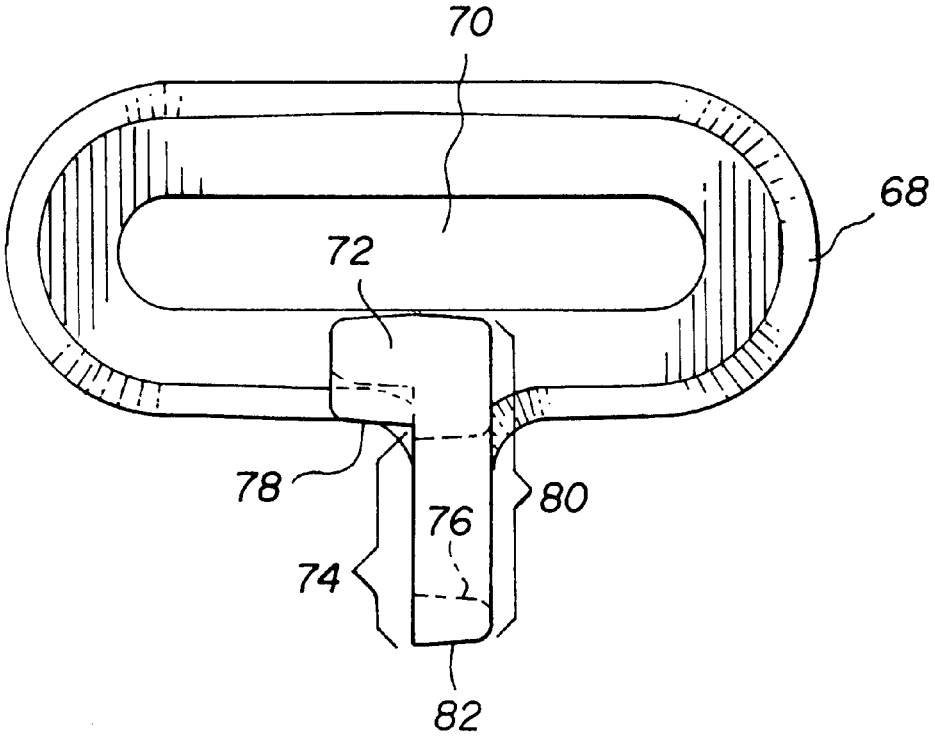
FIG. 6A illustrates a top view of a seam lock tab in accordance with one embodiment of the present invention.

Referring to FIG. 6A, a top view of a seam lock is illustrated. The seam lock has an elliptical, elongated base 68. The center of the base is open along its longitudinal axis forming a slot 70. The slot allows the insertion of a strap that serves to anchor the seam lock. The strap, such as webbing, leather, plastic or fabric, is looped through the seam lock elongated slot 70. The loose ends of the anchoring strap are positioned and sewn or otherwise fastened to a seam adjoining the terminus of the stringer tape. The anchoring strap is made from heavy-duty material thus resisting shear forces. Further, the strap is fastened to a reinforced seam thus strengthening the Low Profile Integrated Omega Zipper Closure System.

Projecting vertically from the base is the seam lock eyelet 80. The seam lock eyelet comprises a neck 72, an eyelet face 74 and a receiving concavity 78. A neck 72 forms the rear of the seam lock eyelet 80. On the front surface of the neck 72 is an eyelet face 74. The eyelet face 74 is offset to one side of the front surface of the neck. The receiving concavity 78 is formed from the other side of the neck front surface. An eyelet 76 to receive a lock shackle is centered in the eyelet face 74. The eyelet face has a circular leading edge 82.

The radius of curvature of the eyelet face circular leading edge 82 is comparable to the radius of curvature of the curved leading edge of the slider body lock eyelet (shown in FIG. 5 as the curved leading edge 47). Similarly, the seam lock receiving concavity 78 has a radius of curvature comparable to the radius of curvature of the slider body lock eyelet receiving concavity (shown in FIG. 5 as receiving concavity 48). This allows a flush docking with an opposing slider body lock eyelet. (The slider body with lock eyelet 44 is illustrated in FIG. 3). The receiving concavity 78 is designed to receive the curved leading edge of an opposing, facing slider body lock eyelet. Repeating what was stated supra, this arrangement optimizes stability of mated, locked eyelets thus lessening torque stress and breakage.

The seam lock, like the pull tab and slider body, is optionally manufactured by a die cast process and is made of a zinc alloy. It is not intended that other manufacturing processes and materials be excluded from the implementation of the present invention. Other metal alloys and plastic compounds may be utilized. A unitized, integrated slider body is the preferred embodiment of the present invention.

Figure 6B:
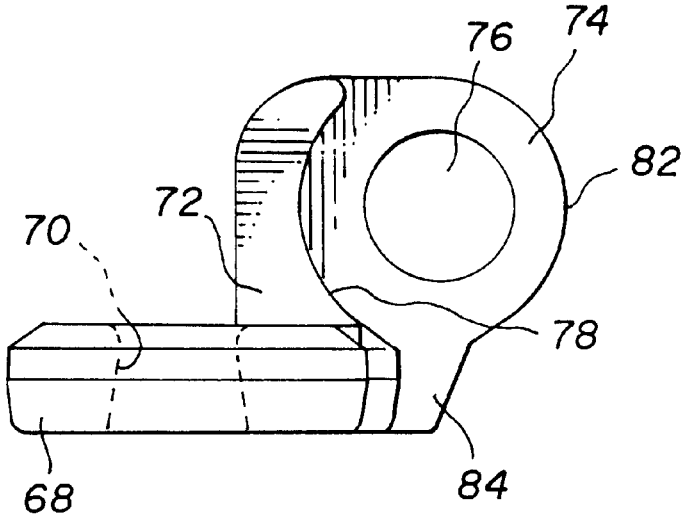
FIG. 6B illustrates a side view of a seam lock tab in accordance with one embodiment of the present invention.

Referring next to FIG. 6B, a side view of the seam lock is illustrated. The seam lock is fitted with a vertical neck 72 from the elliptical, elongated base 68. An eyelet face 74 protrudes from the front surface of the neck 72. An eyelet 76 is present in the eyelet face 74.The eyelet 76 is made so that it mates or nests with a lock eyelet of the zipper slider body. When the zipper slider body docks with the seam lock the respective eyelets align. Receiving concavity 78 allows nesting of a mating lock eyelet from an opposing slider body. A bracing 84 spanning from the front underside of the eyelet face 74 to the base 68 is added to reinforce the strength of the seam lock.

Figure 7:
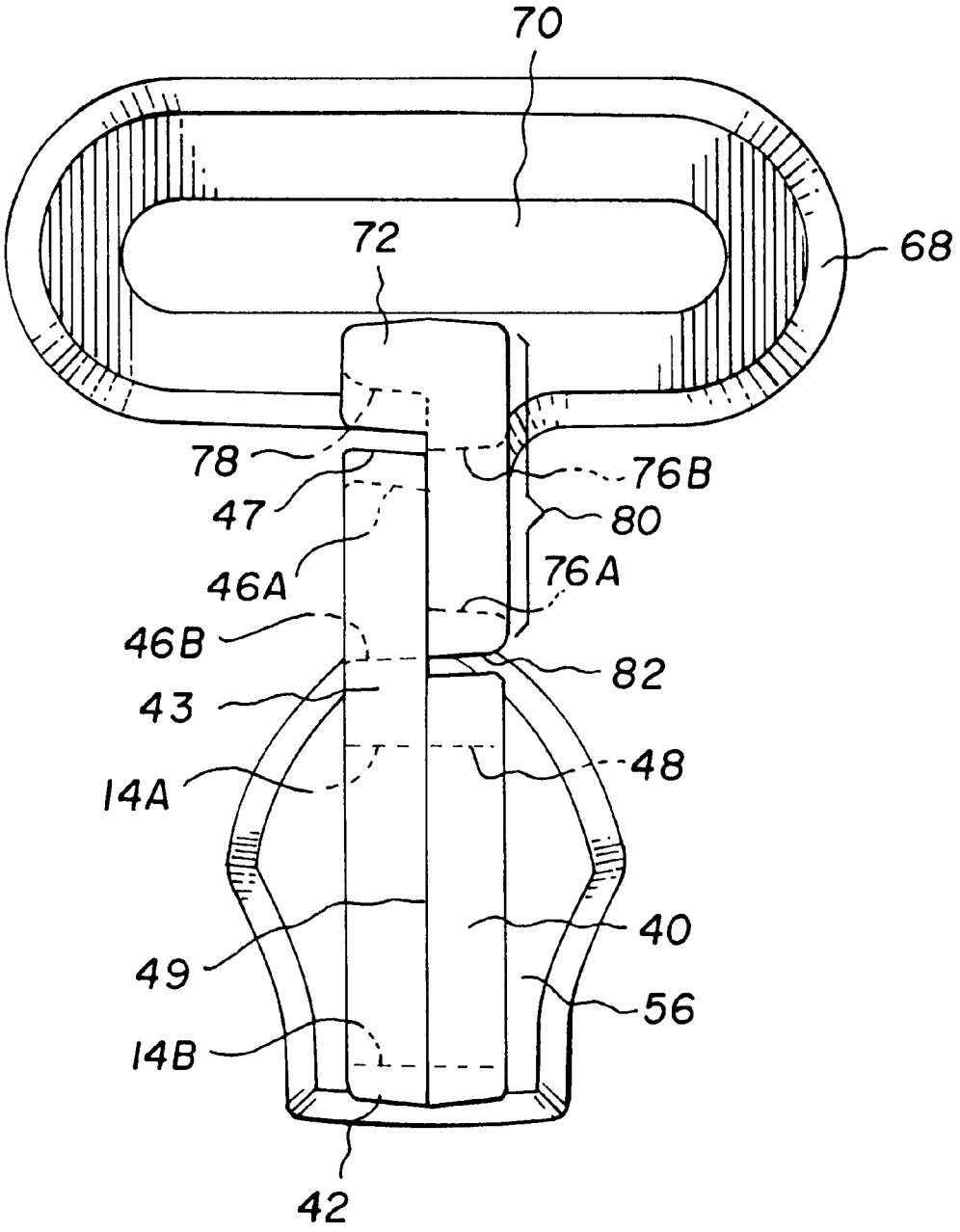
FIG. 7 illustrates a top view of opposing, facing zipper slider body docking with a seam lock in accordance with one embodiment of the present invention.

Referring to FIG. 7 a top view of opposing, facing zipper slider body docking with a seam lock in accordance with one embodiment of the present invention is illustrated. The slider body is positioned in close proximity to the seam lock. The offset seam lock eyelet 80 and the slider body lock eyelet align side by side in a flush manner. When fully docked, the seam lock receiving concavity 78 receives the slider body lock eyelet's leading edge 47. Similarly, the slider body receiving concavity 48 receives the seam lock eyelet's leading edge 82.

Contrast this arrangement with an alternate embodiment of the present invention where the docking of opposing slider bodies, as illustrated in FIG. 5, allowed a lock to be inserted across opposing lock eyelets. When a seam lock is present in the "Low Profile Integrated Omega Zipper Closure System", the need for a second slider body is avoided. The seam lock eyelet is designed to be identical to the slider body lock eyelet with respect to receiving an opposing slider body.

The seam lock is also designed to withstand the same force as a slider body. Further, the seam lock is constructed of the same or similar materials as the slider body and the pull tab. The preferred embodiment of the present uses a die cast process to produce the seam lock.

Once an opposing slider body lock eyelet is nested with the seam lock eyelet, a shackle of a lock is inserted through the pair of aligned eyelets. The nested (parked) seam lock eyelet and slider body lock eyelet allow an inserted lock to lay flat against the body of the product to be secured by the zipper locking system. The lock laying flat on the product's surface keeps the lock down and out of harms way.

In an alternate embodiment of the present invention, the seam lock is positioned inside or adjacent to a pouch. The pouch is designed to receive and restrain the shackled lock. In another embodiment of the present invention the pouch is elasticized thus allowing easy access to the seam lock by stretching the pouch. A lock used to secure the slider body to the seam lock is then contained in the pouch. The elastic properties would tend to keep the seam lock, slider body and lock covered and flat. The lock, seam lock and slider body would thus be out of harm's way, avoiding contact with external mechanical forces such as automated baggage handlers.

Another embodiment of the present invention uses a lock designed to release upon reaching a predetermined force. The slider body lock eyelet and seam lock eyelet will withstand a force in excess of the predetermined force that will cause the lock to release. This embodiment preserves the integrity of the "Low Profile Integrated Omega Zipper Closure System" and the product to which the system is attached when a substantial force is applied to the lock. The lock mechanism is optionally designed in accordance with the present invention. For example, an engaged lock shackle is designed to release from the body of the lock upon the application of a force at or in excess of a predetermined level.

Thus the present invention provides a strengthened break resistant zipper slider body with releasable pull tab connector that is simply and inexpensively repaired has been described to one skilled in the art. It will be apparent to those skilled in the art that other variations in, for example and without limitation, the type of manufacturing process can be accomplished without departing from the scope of the invention as disclosed. For example, the mating of the connector piece to the pull tab may be achieved by utilizing an internal spring deforming the ears outward. When the bottom piece of the connector is inserted in the pull tab cavity, one or more ears are forced inward compressing an internal spring. When bore holes are located, the spring forces the one or more ears into the bore holes. The mechanism still allows the release of the connector piece from the pull tab at a predetermined pull force. Other alternatives or variations include using various designs in the connector piece and pull tab such that the connector piece mates with the pull tab using various forces with the ability to release the connector from the pull tab at a predetermined force without destroying the tab/connector assembly. Such means include various tension forces to snap the connector into the pull tab once aligned in assembled form.

I claim:

1. A zipper apparatus comprising:

a releasing pull tab comprising:

a connector piece comprising:

a closed top portion;

two legs spanning from the closed top end to an open bottom end, said legs being compressible toward the longitudinal axis; and at the bottom end of each leg an ear protruding outward and at an angle from the leg and a pull tab piece comprising:

an interior cavity;

two channels to receive compressed connector legs; and two internal bore holes to receive the connector piece ears wherein the ears are made to release from the bore holes at a predetermined pull force and a zipper slider body comprising a top platform, a bottom platform, a slider body box, a closed slider body bail, a slider body lock eyelet, and a slider body bracing integrated with the lock eyelet, the bottom platform, the top platform and the slider body box.

2. The zipper apparatus of claim 1 wherein all components are constructed of material having sufficient strength to withstand pull forces in excess of 100 pounds without failure and wherein the pull tab connector piece separates from the pull tab at a force not to exceed 100 pounds.

3. The zipper apparatus of claim 1 wherein all components are constructed of material having sufficient strength to withstand pull forces in excess of 150 pounds without failure and wherein the pull tab connector piece separates from the pull tab at a force not to exceed 150 pounds.

4. The zipper apparatus of claim 1 wherein all components are constructed of material having sufficient strength to withstand pull forces in excess of 200 pounds without failure and wherein the pull tab connector piece separates from the pull tab at a force not to exceed 200 pounds.

5. A zipper locking system comprising a plurality of slider body boxes, each slider body box comprising:

a releasing pull tab comprising:

a connector piece comprising:

a closed top portion;

two legs spanning from the closed top end to an open bottom end, said legs being compressible toward the longitudinal axis; and at the bottom end of each leg, an ear protruding outward and at an angle from the leg and a pull tab piece comprising:

an interior cavity;

channels to receive compressed connector legs; and internal bore holes to receive the connector piece ears wherein the ear are made to release from the bore holes at a predetermined pull force; and a zipper slider body comprising a closed slider body bail connected on top of the zipper slider body;

a slider body lock eyelet positioned on top and forward of the zipper slider body wherein the lock eyelet's rear wall is integrated with the slider body bail's forward wall; and a slider body bracing positioned beneath the lock eyelet such that the bracing is integrated with the bottom and rear of the lock eyelet, said bracing is further integrated with the front aspect of the zipper slider body.

6. The zipper locking system of claim 5 comprising two slider body boxes wherein each slider body lock eyelet is reciprocally offset from the center of each slider body box.

7. A zipper locking system comprising a zipper apparatus, a product to which the zipper apparatus is installed and a seam lock, the zipper apparatus comprising:

a releasing pull tab comprising:

a connector piece comprising a closed top portion and two legs spanning from the closed top end to an open bottom end, and a pull tab piece comprising:

an interior cavity including channels to receive the connector legs and means for securing the connector piece to the pull tab to allow the release of the connector from the pull tab at a predetermined pull force; and a zipper slider body comprising a closed slider body bail, a top platform, a bottom platform and a slider body lock eyelet positioned on top of the zipper slider body and integrated with the slider body bail; and a slider body bracing integrated with the lock eyelet, and the zipper slider body.

8. The system of claim 7 wherein a seam lock further comprising:

a base wherein the base is securely fastened to a product to which the zipper apparatus is installed; and a seam lock eyelet protruding vertically from the base so when the zipper slider body is drawn to the seam lock the slider body lock eyelet and the seam lock eyelet align such that an external lock shackle inserted through the aligned seam lock eyelet and slider body lock eyelet secures the zipper apparatus to the seam lock.

9. The system of claim 8 further comprising an anchoring strap wherein the base further comprises a slot adapted for receiving the anchoring strap, wherein the anchoring strap is inserted through the slot engaging the base and wherein the anchoring strap is fastened to the product to which the zipper apparatus is installed.

10. The system of claim 9 wherein the strap is constructed from material selected from the group of materials including canvas, leather, plastic, webbing, polyester, natural fibers and mixtures thereof.

11. The system of claim 9 further comprises: a lock, a stringer; stringer tape; and a seam wherein the stringer is attached to the stringer tape and wherein the stringer tape is fastened to the product to which the zipper apparatus is installed, wherein the stringer tape further comprises a first terminus and a second terminus, wherein the zipper slider body traverses between the first terminus and the second terminus such that when the zipper slider body is positioned at the second terminus the zipper apparatus is closed, wherein the seam is in close proximity to the second terminus, and wherein the anchoring strap is fastened to the seam so that when the slider body lock eyelet and the seam lock eyelet are aligned and shackled with the lock the product to which the zipper apparatus is installed is secured.

12. The system of claim 7 wherein the predetermined force required to cause the pull tab connector ears to release from the pull tab bore holes is between 25 and 200 pounds.

13. The system of claim 12 wherein the seam lock will not fail and no damage to the product will occur at a force less than 100 pounds and wherein the zipper slider body separates from the connector at a force less than 100 pounds.

14. The system of claim 12 wherein the seam lock will not fail and no damage to the product will occur at a force less than 150 pounds and wherein the zipper slider body separates from the connector at a force less than 150 pounds.

15. The system of claim 12 wherein the seam lock will not fail and no damage to the product will occur at a force less than 200 pounds and wherein the zipper slider body separates from the connector at a force less than 200 pounds.

16. A zipper slider body comprising:

a slider body box;

a slider body bottom platform;

a slider body top platform;

a slider body bail;

a slider body lock eyelet positioned forward and on top of the slider body top platform wherein the slider body bail is integrated with the lock eyelet; and a slider body bracing positioned beneath the lock eyelet and integrated with the bottom and rear of the lock eyelet, the slider body bottom platform, the slider body top platform and the slider body box distributing stress across elements of the zipper slider body.

17. The zipper slider body of claim 16 wherein no component of the zipper slider body will fail with an application of less than 100 pounds of force.

18. The zipper slider body of claim 16 wherein no component of the zipper slider body will fracture with an application of less than 150 pounds of force.

19. The zipper slider body of claim 16 wherein no component of the zipper slider body will fracture with an application of less than 200 pounds of force.

20. A seam lock for use in a zipper locking system comprising:

a base; and a seam lock eyelet comprising:

a neck protruding vertically from the base said neck comprises a front surface;

an eyelet face positioned forward the neck front surface;

an eyelet approximately centered within the eyelet face, wherein the base and the seam lock eyelet are constructed as a single, integral unit and wherein the seam lock is attached to a product to which the zipper locking system is secured; and a seam lock bracing positioned beneath the eyelet face such that the seam lock bracing is integrated with the bottom of the eyelet face, said bracing is further integrated with the front aspect of the seam lock base.

21. The seam lock of claim 20 wherein the eyelet face is offset to a side of the neck front surface and wherein the eyelet face comprises a front edge said front edge being shaped like an arc of a circle.

22. The seam lock of claim 21 wherein the neck front surface further comprises a receiving concavity said receiving concavity positioned on a side of the neck front surface opposite the side the eyelet face is offset and wherein the receiving concavity has a radius of curvature sufficient to receive an eyelet face front edge of an identical seam lock.

23. The seam lock of claim 22 wherein the base is elliptically shaped and wherein the base further comprises a slot along the longitudinal axis of the base.

24. The seam lock of claim 22 wherein the seam lock is attached to the product to which the zipper locking system is secured with a strap that is passed through the slot, engaging the base so as to anchor the base.

25. The seam lock of claim 20 wherein the seam lock is manufactured by a process selected from the group comprising die casting and molding with material selected from the group comprising zinc alloy, carbon fiber composite, fiber reinforced plastics, steel, aluminum, titanium, copper beryllium and alloys and mixtures thereof.

26. The seam lock of claim 25 wherein all components are constructed of material having sufficient strength to withstand pull forces in excess of 100 pounds without failure.

27. The seam lock of claim 25 wherein all components are constructed of material having sufficient strength to withstand pull forces in excess of 150 pounds without failure.

28. The seam lock of claim 25 wherein all components are constructed of material having sufficient strength to withstand pull forces in excess of 200 pounds without failure.

* * * * *